US009951953B2

(12) United States Patent
Hansen

(10) Patent No.: US 9,951,953 B2
(45) Date of Patent: Apr. 24, 2018

(54) TORCH WITH WEIGHTED SAFETY SNUFFER

(71) Applicant: Lamplight Farms Incorporated, Menomonee Falls, WI (US)

(72) Inventor: Lars Hansen, Holstebro (DK)

(73) Assignee: Lamplight Farms Incorporated, Menomonee Falls, WI (US)

( * ) Notice: Subject to any disclaimer, the term of this patent is extended or adjusted under 35 U.S.C. 154(b) by 402 days.

(21) Appl. No.: 14/707,942

(22) Filed: May 8, 2015

(65) Prior Publication Data

US 2016/0327270 A1 Nov. 10, 2016

(51) Int. Cl.

| | |
|---|---|
| ***F23Q 25/00*** | (2006.01) |
| ***F23D 3/26*** | (2006.01) |
| ***F21V 37/00*** | (2006.01) |

(52) U.S. Cl.

CPC ..... *F23Q 25/00* (2013.01); *F21V 37/0008* (2013.01); *F23D 3/26* (2013.01); *F21V 37/002* (2013.01)

(58) Field of Classification Search

CPC ... F16K 17/36; F16K 17/366; A47G 19/2272; F23D 3/26; F23Q 25/00

See application file for complete search history.

(56) References Cited

U.S. PATENT DOCUMENTS

| | | | | |
|---|---|---|---|---|
| 189,826 | A * | 4/1877 | Wood | F23Q 25/00 431/34 |
| 412,969 | A | 10/1889 | Miller | |
| 481,268 | A | 8/1892 | Price | |
| 2,022,897 | A | 12/1935 | Neumeister | |
| 6,159,002 | A | 12/2000 | LeJeune | |
| 6,960,320 | B1 | 11/2005 | Smith et al. | |
| D679,048 | S | 3/2013 | White | |
| 8,439,669 | B2 | 5/2013 | Masterson et al. | |
| 2004/0081268 | A1 | 4/2004 | Klarner | |
| 2009/0068608 | A1 | 3/2009 | Hansen | |
| 2010/0112504 | A1 | 5/2010 | Reed | |
| 2013/0027918 | A1 | 1/2013 | White | |
| 2013/0323659 | A1 | 12/2013 | White | |
| 2015/0167966 | A1 | 6/2015 | Hansen | |

FOREIGN PATENT DOCUMENTS

| | | |
|---|---|---|
| JP | 58158427 | 9/1983 |

OTHER PUBLICATIONS

European Search Report, Application No. 16168132.5, dated Oct. 10, 2016, Applicant: Lamplight Farms Incorporated.

* cited by examiner

*Primary Examiner* — Jason Lau
(74) *Attorney, Agent, or Firm* — David G. Woodral; Gable Gotwals

(57) ABSTRACT

A device includes a flame bowl with a snuffer sleeve situated therein. The snuffer sleeve has a lowered position allowing a wick to burn freely and a raised position wherein the sleeve impedes oxygen flow to the wick, the snuffer sleeve being biased toward the raised position. A shelf extends from the snuffer sleeve to receive a movable weight that rests on the shelf when the flame bowl is upright and the snuffer sleeve is moved to the lowered position. The movable weight retains the snuffer sleeve in the lowered position while the flame bowl remains upright but moves to allow the snuffer sleeve to extend to the raised position when the flame bowl departs from the upright position more than a predetermined amount.

19 Claims, 5 Drawing Sheets

TORCH WITH WEIGHTED SAFETY SNUFFER

BACKGROUND OF THE INVENTION

Liquid fueled torches are utilized for a number of purposes such as lighting, decoration, and pest repellence. This disclosure relates to liquid fueled torches with added features.

SUMMARY OF THE INVENTION

The invention of the present disclosure, in one aspect thereof, comprises a device with a flame bowl providing a wick holder passing from an upper surface of the flame bowl to a fuel reservoir. A snuffer has a snuffer sleeve that circumscribes at least a portion of the wick holder and is movable between a lowered position, in which a wick extending upwardly from the wick holder is exposed, and a raised position, in which a wick extending upwardly from the wick holder is at least partially shielded by the snuffer sleeve. A biasing member biases the snuffer toward the raised position. When the flame bowl is in an upright position, the wick holder is retained by gravity in the lowered position, and when flame bowl departs from the upright position more than a predetermined amount the biasing member extends the snuffer to the raised position.

In some embodiments, a top plate is fixed in a position over the flame bowl such that the snuffer comes into contact with the top plate when in the raised position. A detached weight may sits in contact with a snuffer shelf proceeding from the sleeve when the flame bowl is in the upright position. The detached weight moves away from the shelf allowing the snuffer to extend when the flame bowl departs from the upright position The flame bowl may be at least partially frustoconical with the wick holder and the snuffer sleeve extending below a lower center portion thereof such that when the flame bowl is upright with the snuffer sleeve in the lowered position, the detached weight will move into contact with a shelf on the snuffer sleeve to retain the snuffer sleeve in the lowered position.

A grate may be placed over the flame bowl for preventing loss of the free weight. The grate may fix a top plate in a position over the flame bowl such that the snuffer comes into contact with the top plate when in the raised position. The device may further comprise a removable flame bowl cap with at least one tab extending downwardly therefrom such that when the flame bowl cap is placed upon the flame bowl the tab forces the snuffer to the lowered position whereupon the detached weight comes into contact with a shelf on the snuffer to retain it in the lowered position when the cap is removed with the flame bowl upright.

The invention of the present disclosure, in another aspect thereof, comprises a device with a flame bowl having a frustoconical portion surrounding a recess in lower portion thereof. A wick holder passes through the recess from a fuel reservoir below the flame bowl into the frustoconical portion. The device has a snuffer with a sleeve at least partially within the recess and circumscribing the wick holder. The snuffer has a lowered position where the snuffer sleeve is at or below a level of the wick holder and a raised position where the snuffer sleeve extends at least partially beyond a level of the wick holder. A spring biases the snuffer toward the raised position. The device has at least one movable weight that retains the snuffer in the lowered position when the flame bowl is substantially upright but moves away from the snuffer allowing it to extend to the raised position when the flame bowl departs from an upright position by more than a predetermined angle.

The snuffer may further comprise a weight shelf extending laterally from the snuffer sleeve, the weight shelf bearing the movable weight when the snuffer is in the lowered position and the flame bowl is substantially upright. The weight shelf may circumscribe the snuffer sleeve and substantially match the slope of the frustoconical portion of the flame bowl. The movable weight may comprise a plurality of spherical weights.

In some embodiments, the wick holder provides a first upper flange that is surrounded by a second upper flange on the snuffer sleeve when the snuffer sleeve is in the lowered position. A top plate may be suspended in a fixed position above the flame bowl by a wire grate that prevents loss of the movable weight, the second upper flange contacting the top plate when the snuffer is in the raised position.

The device may include a removable flame bowl cover having at least one downwardly extending tab sized and located to pass through the wire grate and into contact with the second upper flange to press the snuffer into the lowered position when the cover is placed into the flame bowl. In such cases the snuffer may provide a shelf that receives the movable weight for retaining the snuffer in the lowered position when the snuffer is pressed into the lowered position by the flame bowl cover and the flame bowl is in an upright orientation.

The invention of the present disclosure, in another aspect thereof, comprises a torch with a flame bowl providing a wick holder passing from an upper surface of the flame bowl to a fuel reservoir, a snuffer with a snuffer sleeve circumscribing at least a portion of the wick holder and being movable between a lowered position, in which a wick extending upwardly from the wick holder is exposed, and a raised position, in which a wick extending upwardly from the wick holder is at least partially shielded by the snuffer sleeve, and a biasing member that biases the snuffer toward the raised position. When the flame bowl is in an upright position, the wick holder is retained by gravity in the lowered position. When flame bowl departs from the upright position more than a predetermined amount, the biasing member extends the snuffer to the raised position in response to an impact between the torch and a surface that supported the torch prior to the flame bowl departing from the upright position.

Some embodiments of the torch provide comprise a top plate fixed in a position over the flame bowl such that the snuffer comes into contact with the top plate when in the raised position. The torch may further comprising a detached weight that sits in contact with a snuffer shelf proceeding from the sleeve when the flame bowl is in the upright position and moves away from the shelf allowing the snuffer to extend when the flame bowl departs from the upright position in response to the impact of the torch with the surface that supported the torch prior to the flame bowl departing from the upright position.

In some embodiments, the flame bowl is at least partially frustoconical with the wick holder and the snuffer sleeve extending below a lower center portion thereof such that when the flame bowl is upright with the snuffer sleeve in the lowered position, the detached weight will move into contact with a shelf on the snuffer sleeve to retain the snuffer sleeve in the lowered position. The torch may include a grate over the flame bowl for preventing loss of the free weight.

DETAILED DESCRIPTION OF THE PREFERRED EMBODIMENTS

Figure 1:
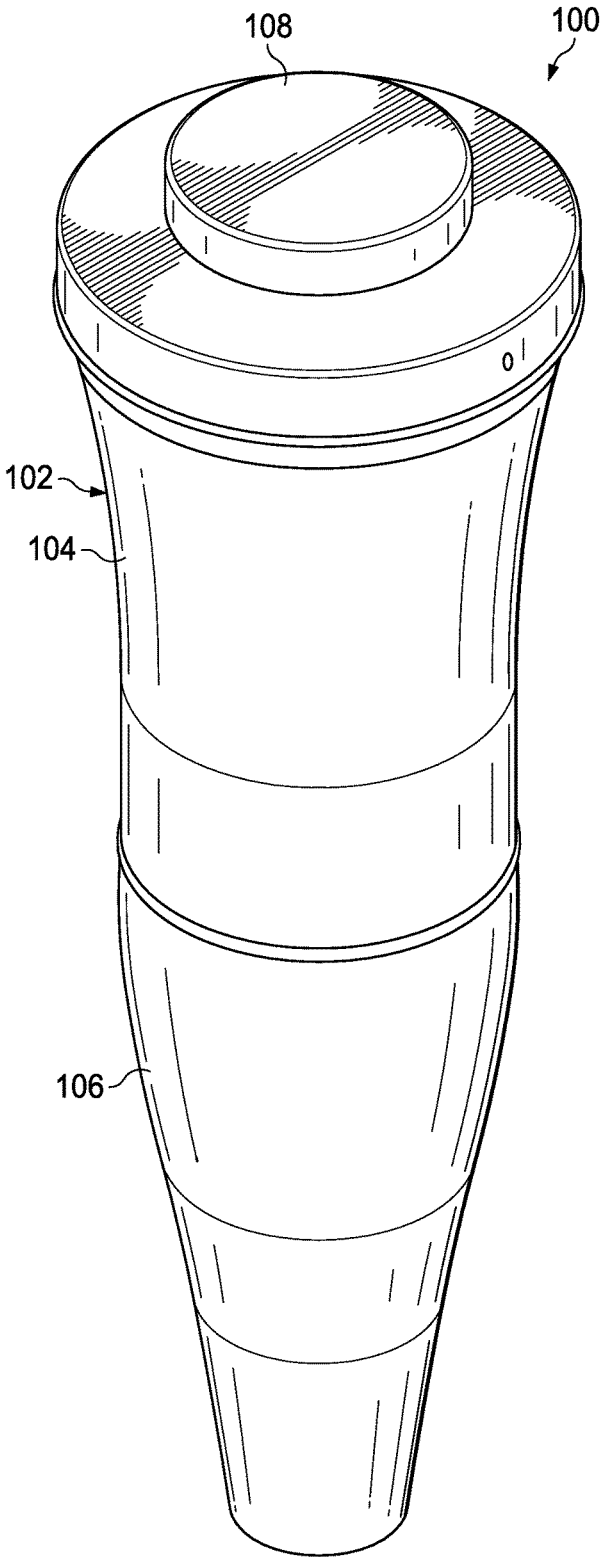
FIG. 1 is a perspective view of a liquid fueled torch according to the present disclosure.

Referring now to FIG. 1, a perspective view of one embodiment of a liquid fueled torch 100 according to the present disclosure is shown. Various embodiments of the present disclosure comprise a torch body 102. The torch body 102 may comprise a fuel reservoir 104 that receives a quantity of liquid torch fuel. Such fuel may be petroleum based or based upon plant oils or other base mixtures. In some cases, citronella oil may be used for insect repellant properties. Additives may also be supplied with the oil to alter burn characteristics or otherwise provide enhanced performance of the fuel.

The torch body 102 may also comprise a base or pole adapter 106. The torches of the present disclosure may be configured as table-top devices, may be mounted to poles (not shown) that affix into the ground, or may be mounted to other stands that provide elevation of the torch. Users may prefer an elevated torch for various reasons including, but not limited to, greater lighting performance, better chemical or scent dispersal, and keeping the flame further away from combustible material on the ground.

A cap 108 may be provided for covering the torch 100 when not in use. The cap 108 may be affixed to the body 102 with a tether. The cap 108 may also operate as a snuffer, as described in greater detail below. The body 102 and cap 108 may comprise steel or another heat resistant alloy. They may be painted with heat resistant paint for protection from oxidation. In some embodiments, the material may be stainless with a brushed or polished finish.

Figure 2:
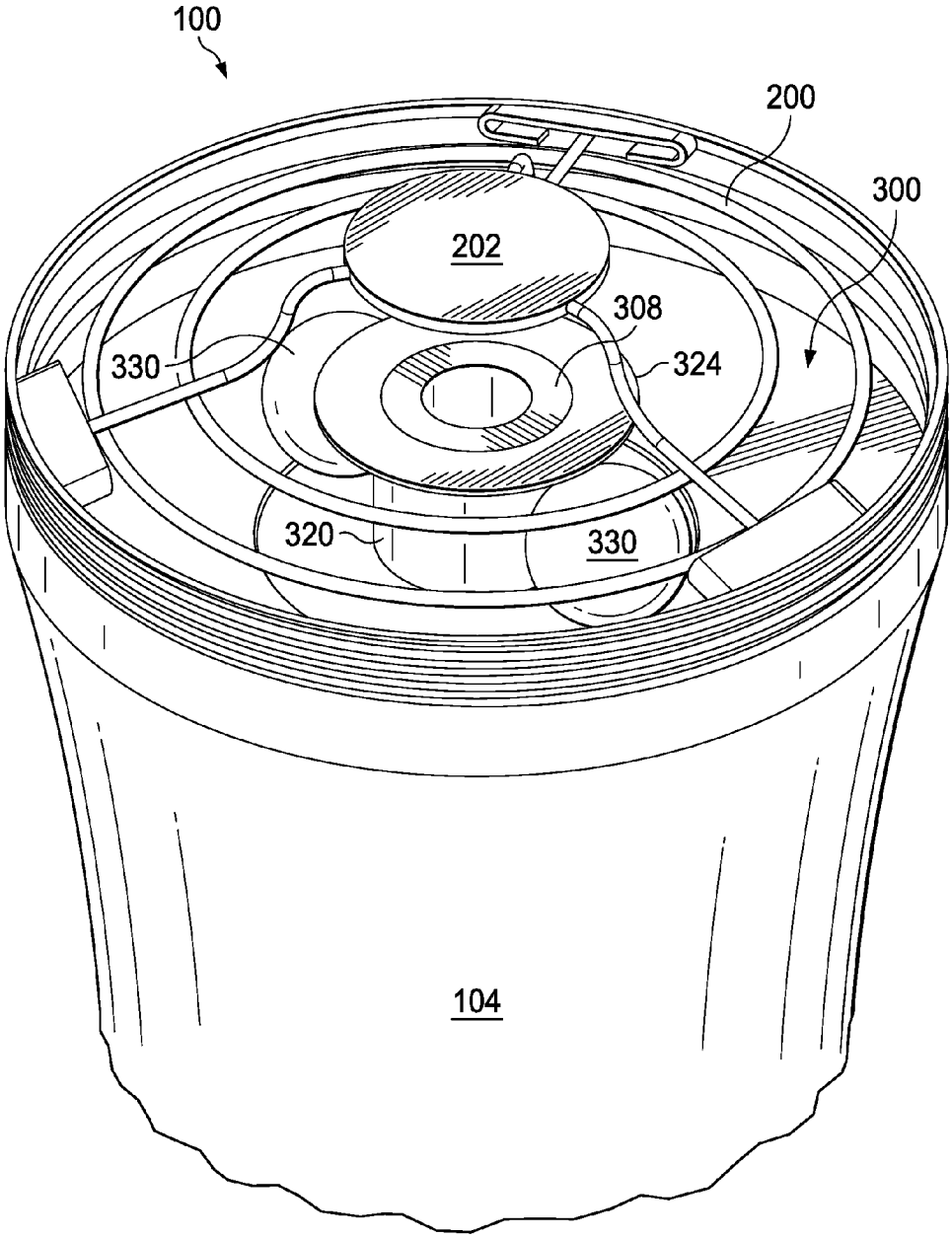
FIG. 2 is a perspective view of a liquid fueled torch according to the present disclosure shown with the flame bowl cap removed.

Referring now to FIG. 2, a perspective view of the liquid fueled torch 100 according to the present disclosure shown with the flame bowl cap 108 removed. Here, a flame bowl 300 can be seen. In the present embodiment, for reasons discussed below, the flame bowl 300 is covered by a grating 200. The grating may comprise wire or another material cut out to reveal the flame bowl 300 below. The grating 200 may affix to the flame bowl 300 and/or the torch body 102. The grating 200 may suspend a top plate 202 over the flame bowl 300, possibly near the center thereof. The grating 200 does not necessarily have the exact appearance shown and in some cases a mesh or grid covering may be utilized as the grating 200.

Figure 3:
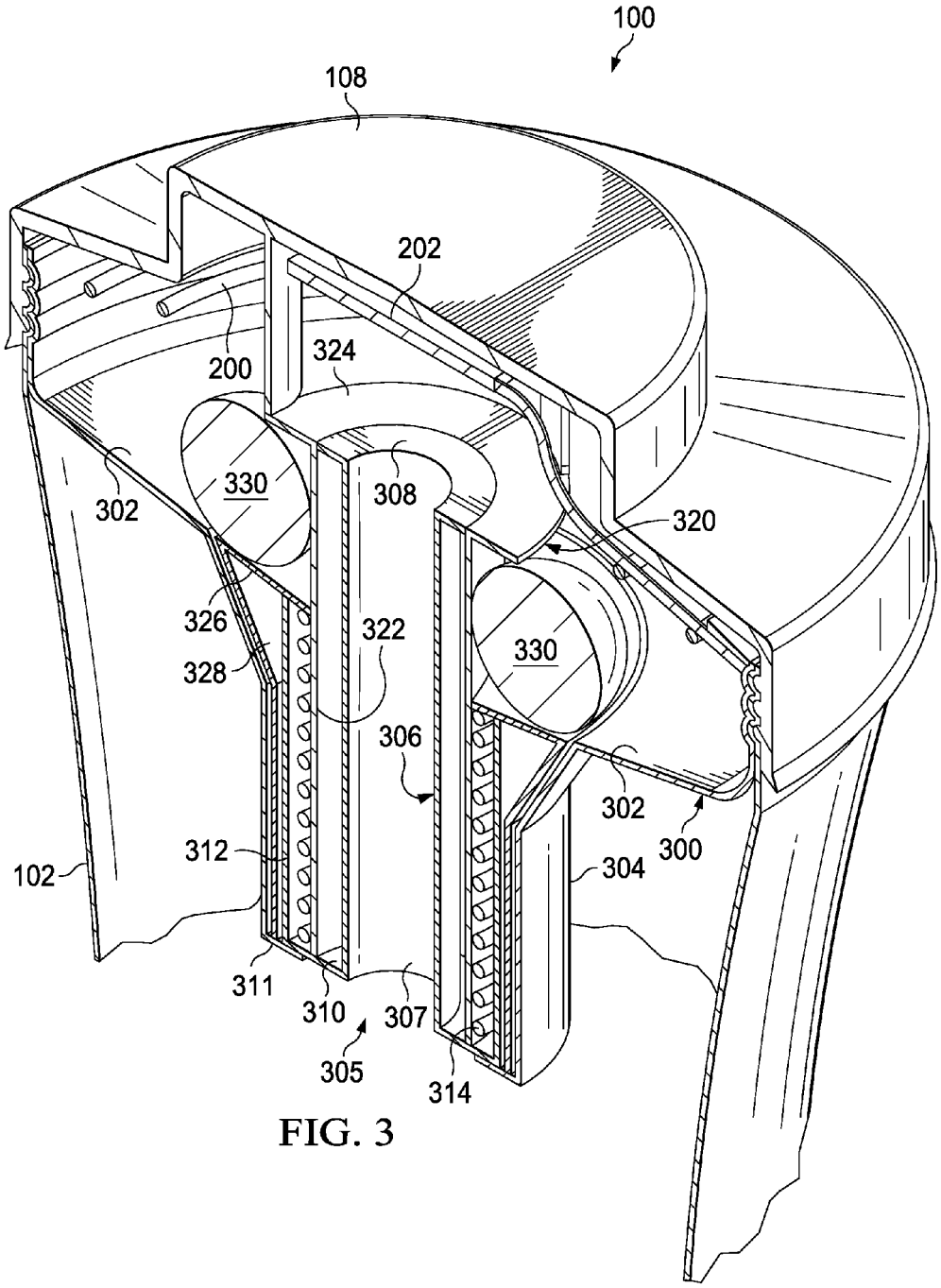
FIG. 3 is a side cutaway perspective view of a liquid fueled torch according to the present disclosure.

Referring now to FIG. 3, a side cutaway perspective view of the liquid fueled torch 100 according to the present disclosure is shown. Here, the torch 100 is shown with the cap 108 attached. The cap 108 fits onto the torch body 102 in a friction fit relationship and is sufficiently well mated with the body 102 so as to smother any flame if placed onto the body 102 when the torch 100 is operational or ignited.

The flame bowl 300 may be fitted into the torch body 102 to rest above the reservoir 104. The flame bowl 300 may have a frustoconical section 302 that may form a sloped floor of the flame bowl 300. The frustoconical section 302 may be more elevated radially and slope downward medially. In other embodiments, the flame bowl 300 is sloped downward toward a medial or central portion, but may not necessarily be strictly frustoconical. At or near the center or medial portion of the floor a recess 304 may be defined in the flame bowl 300. The recess 304 extends further downward into the reservoir 104. The recess 304 may be continuous with the upper segments of the flame bowl 300 but at least a portion of the recess 304 is occupied with the structure shown (and described further below) and may not actually be exposed to flame.

The recess 304 may terminate in an opening 305 defined inside or proximate to the fuel reservoir 104. The opening 305 allows a wick (not shown in FIG. 3 for clarity) to access fuel (not shown) in the reservoir. In various embodiments of the present disclosure, the wick may be a permanent wick such as a woven fiberglass wick. A wick holder 306 may occupy a portion of the recess 304 for holding the wick in a friction fit or other stable relationship. In some embodiment the wick holder 306 comprises a central tubular passage 307, in which the wick may be held. Fuel drawn from the reservoir 104 by the wick may be burned in the flame bowl 300.

The wick holder tube 307 may be provided with an upper flange 308 and a lower flange 310. The lower flange 310 may extend laterally from the tube 307 to rest upon an inwardly projecting shelf 311 projecting from the recess 304 and circumscribing opening 305. The lower flange 310 may form a portion of a cup 312 that surrounds a lower portion of the wick holder 306. A biasing member 314 sits within the cup 312 and applies an upward force against an extensible snuffer 320. The biasing member 314 may be a coil spring as shown, but could also be a leaf spring, and heat resistant elastomeric member or another biasing device.

The extensible snuffer 320 provides a snuffer sleeve 322 that, in the present embodiment, is roughly as long as the wick holder tube 307. In this manner, the snuffer sleeve 322 will terminate in the flame bowl 300 at approximately the same level as the wick holder 306. A flange 324 may be affixed to the upper end of the snuffer sleeve 322.

Extending radially from the snuffer sleeve 322 is a shelf 326. The shelf 326 may extend at somewhat of an angle in order to match the slope of the frustoconical section 302. The shelf 326 may be located along the length of the snuffer sleeve 322 such that a continuous slope is formed between the shelf 326 and the frustoconical section 302 when the snuffer 320 is fully seated into the cup 312 and/or recess 304. The shelf 326 may also provide a surface against which the biasing member 314 will bear to urge the snuffer 320 upward.

Extending downwardly from a distal edge of the shelf 326 may be a skirt 328. The skirt 328 may not have a continuous angle but may be segmented as shown to match the contours of recess 304 such that the skirt 328 does not inhibit seating of the snuffer 320.

Figure 4:
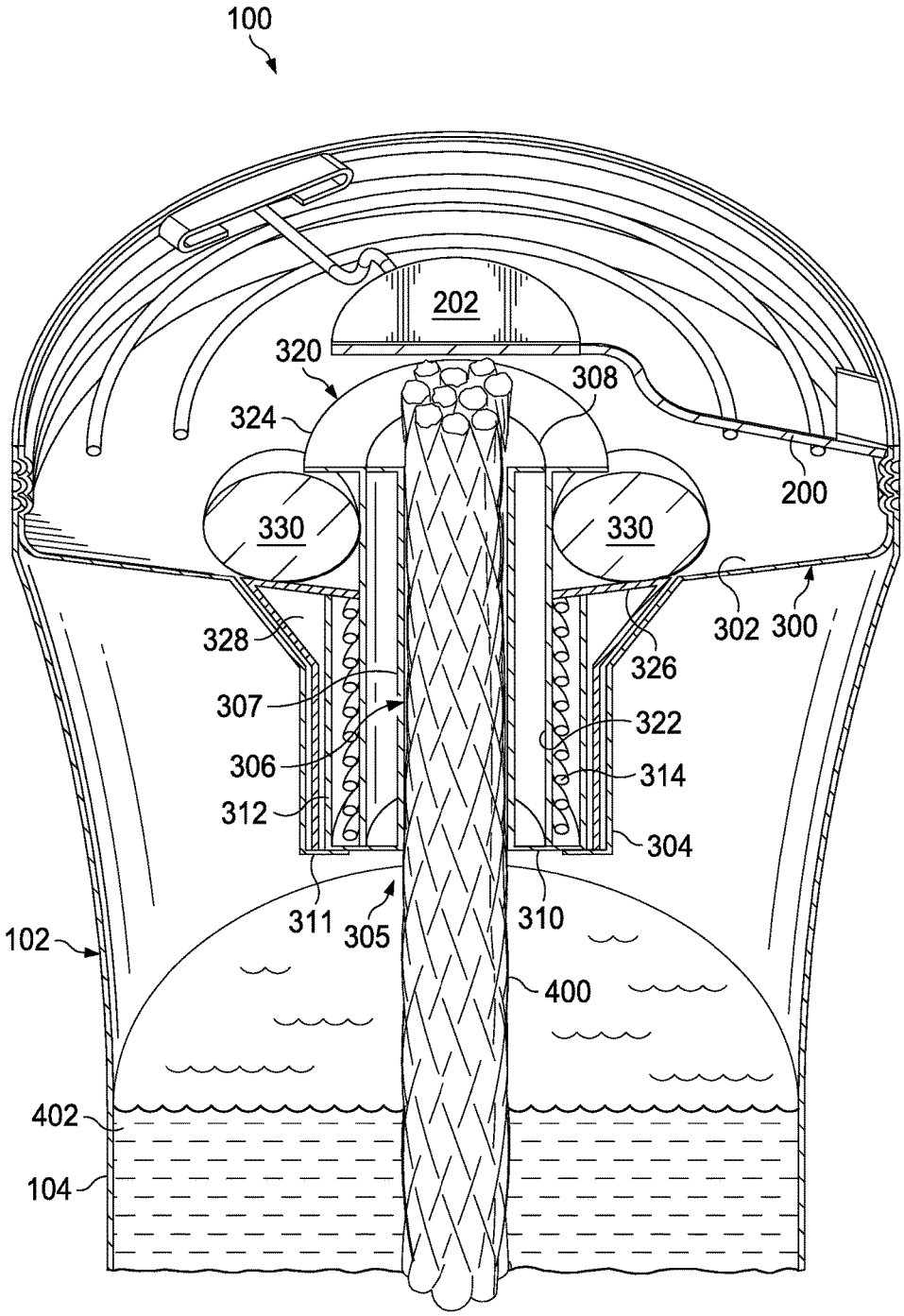
FIG. 4 is a side cutaway perspective view of the torch of FIG. 3 shown with the lid removed and the snuffer sleeve retracted for operation of the torch.

Referring now also to FIG. 4, a side cutaway perspective view of the torch 100 of FIG. 3 with the cap 108 removed is shown. FIG. 4 also illustrates placement of the wick 400 and a quantity of liquid fuel 402 in the reservoir 104. In the operational configuration shown, the snuffer 310 is seated into the cup 312 and/or recess 304. The biasing member 314 urges the snuffer 320 upward such that it would impede oxygen flow to the wick. However, a pair of spherical weights 330 rest upon the shelf 326 and prevent the snuffer from elevating. The slope of the floor of the flame bowl 300 ensures that the weights are urged by gravity into the shelf 326. The weights 330 are spherical in the present embodiment but they could have other shapes so long as they are able to move under force of gravity onto the shelf 326. Further, two weights 330 are shown in the present embodiment but more weights could be utilized. Correspondingly, if the density is sufficient, a single weight 330 may be used. The force or strength of the biasing member 314 can also be selected to ensure that the snuffer 320 remains in place when weighted, but is elevated when unweighted.

Figure 5:
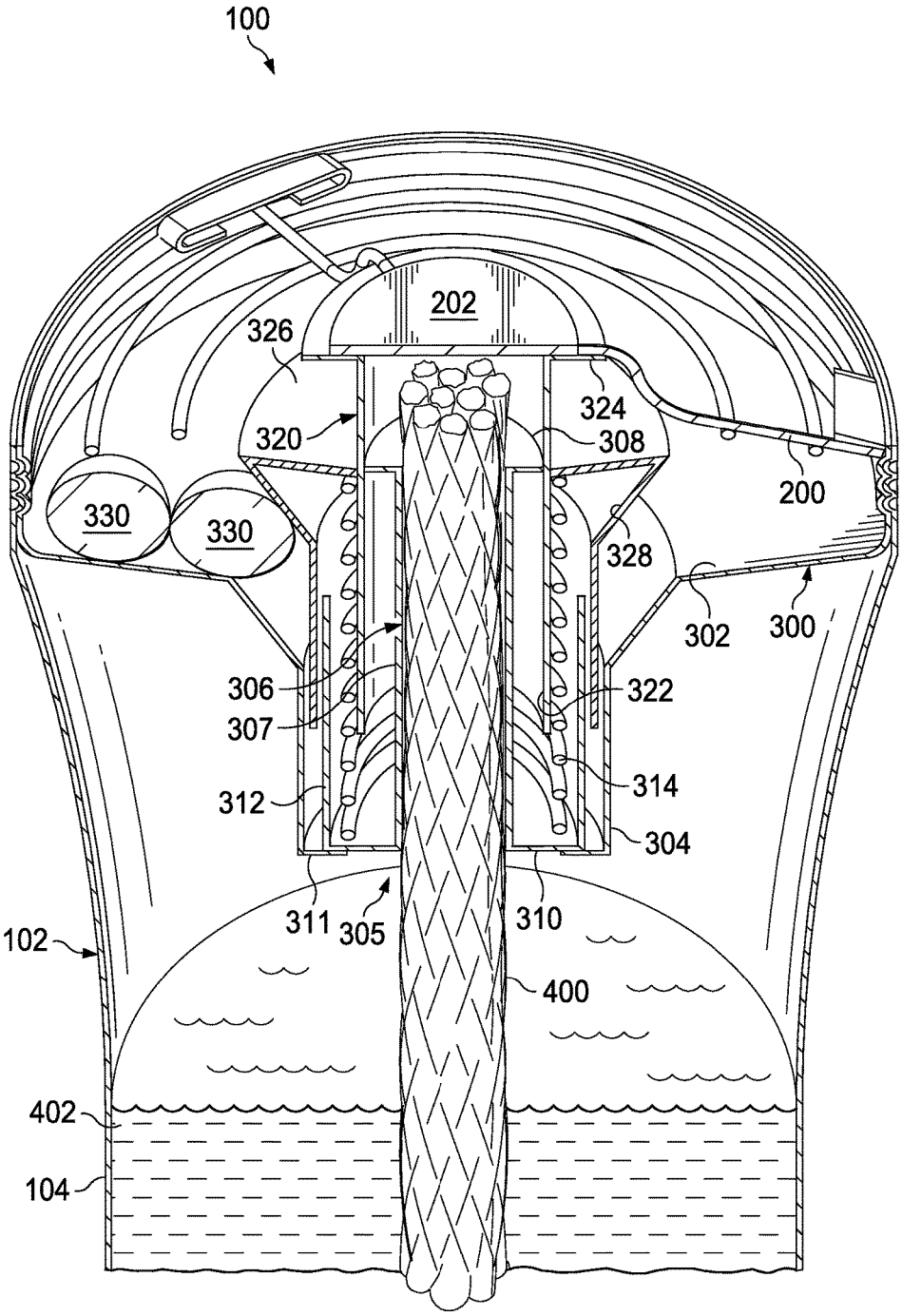
FIG. 5 is a side cutaway perspective view of the torch of FIG. 3 shown with the lid removed and the snuffer sleeve extended so as to extinguish the torch.

Referring now to FIG. 5, a side cutaway perspective view of the torch 100 of FIG. 3 is shown with the cap 108 removed and the snuffer 320 extended so as to extinguish the torch 100. When the torch 100 is tipped from vertical by more than a predetermined amount, the weights 330 will roll off or move from the shelf 326. The degree of tilt necessary to allow the weights 330 to move is approximately any angle greater than the angle at which the shelf 326 and/or the frustoconical section 302 is sloped downward. The weights 330 will tend to move to the lowest point on the shelf 326 and when the shelf or floor of the flame bowl 300 has moved beyond their normal angle (when the torch is straight up) then no effective slope will remain and the weights 330 will move away from the shelf 326. FIG. 5 is illustrated with the weights 330 shifted off the shelf 326 to the left—as though the torch 100 were tipped onto its left side in the current frame of reference.

With the weights removed from the shelf 326, the snuffer 320 is lifted upward (or out of the recess 304) by the biasing member 314. This allows the snuffer sleeve 322 to surround the exposed portion of the wick 400, thereby starving it of oxygen and extinguishing the flame in the event of a tip over of the torch 100. The snuffer sleeve 322 and/or the flange 324 may come into contact with top plate 202, which will further serve to deprive the wick of oxygen and extinguish its flame.

Although the skirt 328 may help to maintain centering of the snuffer 320 within the recess 304, it also importantly provides an angled surface that will force weights 330 away from the snuffer 320 if the snuffer is depressed from the extended or upper position (FIG. 5) to the seated or lowered position (FIGS. 3 and 4) when the torch 100 is upright. The cap 108 provides a plurality of downwardly extending tabs 110 that are sized and spaced so as to fit into the flame bowl 300 through openings or gaps in the grating 200. These bear against or press down upon the flange 324 to force the snuffer 320 back into the seated position. The weights 330 will first be forced away from the recess by the skirt 328 and then come back to rest on the shelf 326, thereby resetting the torch 100. With the weights 330 in place on the shelf 326 and the torch 100 upright, the cap 108 may be removed and the torch 100 relit.

In some embodiments of the present disclosure, the weights 330 are not provided. In such cases the snuffer 320 operates based upon gravity and the angle at which the torch 100 is sitting. The snuffer 320 may also be somewhat simpler in design. For example, shelf 326 and/or skirt 328 may not be needed if not for managing and properly locating weights.

The degree to which the torch 100 must tip or tilt in order to deploy the snuffer 324 distally such that any flame is extinguished may vary depending upon a number of factors. One such factor is the strength or spring rate of the biasing member 314. Another factor is the weight of the snuffer 324. In one embodiment, the biasing member 314 and weight of the snuffer 324 are configured such that the snuffer 324 extends against the top plate 202 if the torch 100 has tilted more than about 30 degrees.

In some embodiments, maximum extension is not achieved until the torch 100 has tilted by greater than about 45 degrees. In further embodiments still, the biasing member 314 and snuffer 324 may be configured such that maximum distal extension is not achieved until the torch 100 is tilted approximately 90 degrees, which would correspond to the torch 100 having been tipped completely onto its side. Some embodiments perform in use such that maximum distal (upper) extension of the snuffer 324 is assured by an approximately 90 degree (or greater) tilt accompanied by an impact that would correspond to the torch 100 having impacted the ground or other supporting surface upon turning over completely.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

For purposes of the instant disclosure, the term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. Terms of approximation (e.g., "about", "substantially", "approximately", etc.) should be interpreted according to their ordinary and customary meanings as used in the associated art unless indicated otherwise. Absent a specific definition and absent ordinary and customary usage in the associated art, such terms should be interpreted to be ±10% of the base value.

When, in this document, a range is given as "(a first number) to (a second number)" or "(a first number)-(a second number)", this means a range whose lower limit is the first number and whose upper limit is the second number.

For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising of two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A device comprising:

a flame bowl providing a wick holder passing from an upper surface of the flame bowl to a fuel reservoir;

a snuffer with a snuffer sleeve circumscribing at least a portion of the wick holder and being movable between a lowered position, in which a wick extending upwardly from the wick holder is exposed, and a raised position, in which a wick extending upwardly from the wick holder is at least partially shielded by the snuffer sleeve;

a biasing member that biases the snuffer toward the raised position; and a top plate fixed in a position over the flame bowl such that the snuffer comes into contact with the top plate when in the raised position;

wherein when the flame bowl is in an upright position, the wick holder is retained by gravity in the lowered position; and wherein when flame bowl departs from the upright position more than a predetermined amount the biasing member extends the snuffer to the raised position.

2. The device of claim 1, further comprising a detached weight that sits in contact with a snuffer shelf proceeding from the sleeve when the flame bowl is in the upright position and moves away from the shelf allowing the snuffer to extend when the flame bowl departs from the upright position.

3. The device of claim 2, wherein the flame bowl is at least partially frustoconical with the wick holder and the snuffer sleeve extending below a lower center portion thereof such that when the flame bowl is upright with the snuffer sleeve in the lowered position, the detached weight will move into contact with a shelf on the snuffer sleeve to retain the snuffer sleeve in the lowered position.

4. The device of claim 3, further comprising a grate over the flame bowl for preventing loss of the free weight.

5. The device of claim 4, wherein the grate fixes a top plate in a position over the flame bowl such that the snuffer comes into contact with the top plate when in the raised position.

6. The device of claim 1, further comprising a removable flame bowl cap with at least one tab extending downwardly therefrom such that when the flame bowl cap is placed upon the flame bowl the tab forces the snuffer to the lowered position whereupon the detached weight comes into contact with a shelf on the snuffer to retain it in the lowered position when the cap is removed with the flame bowl upright.

7. A device comprising:

a flame bowl having a frustoconical portion surrounding a recess in lower portion thereof;

a wick holder passing through the recess from a fuel reservoir below the flame bowl into the frustoconical portion;

a snuffer with a sleeve that is at least partially within the recess and circumscribing the wick holder, the snuffer having a lowered position where the snuffer sleeve is at or below a level of the wick holder and a raised position where the snuffer sleeve extends at least partially beyond a level of the wick holder;

a spring that biases the snuffer toward the raised position; and at least one movable weight that retains the snuffer in the lowered position when the flame bowl is substantially upright but moves away from the snuffer allowing it to extend to the raised position when the flame bowl departs from an upright position by more than a predetermined angle.

8. The device of claim 7, wherein the snuffer further comprises a weight shelf extending laterally from the snuffer sleeve, the weight shelf bearing the movable weight when the snuffer is in the lowered position and the flame bowl is substantially upright.

9. The device of claim 8, wherein the weight shelf circumscribes the snuffer sleeve and substantially matches the slope of the frustoconical portion of the flame bowl.

10. The device of claim 9, wherein the movable weight comprises a plurality of spherical weights.

11. The device of claim 7, wherein the wick holder provides a first upper flange that is surrounded by a second upper flange on the snuffer sleeve when the snuffer sleeve is in the lowered position.

12. The device of claim 11, further comprising a top plate suspended in a fixed position above the flame bowl by a wire grate that prevents loss of the movable weight, the second upper flange contacting the top plate when the snuffer is in the raised position.

13. The device of claim 12, further comprising a removable flame bowl cover having at least one downwardly extending tab sized and located to pass through the wire grate and into contact with the second upper flange to press the snuffer into the lowered position when the cover is placed into the flame bowl.

14. The device of claim 13, wherein the snuffer provides a shelf that receives the movable weight for retaining the snuffer in the lowered position when the snuffer is pressed into the lowered position by the flame bowl cover and the flame bowl is in an upright orientation.

15. A torch comprising:

a flame bowl providing a wick holder passing from an upper surface of the flame bowl to a fuel reservoir;

a snuffer with a snuffer sleeve circumscribing at least a portion of the wick holder and being movable between a lowered position, in which a wick extending upwardly from the wick holder is exposed, and a raised position, in which a wick extending upwardly from the wick holder is at least partially shielded by the snuffer sleeve; and a biasing member that biases the snuffer toward the raised position;

wherein when the flame bowl is in an upright position, the wick holder is retained by gravity in the lowered position; and wherein when flame bowl departs from the upright position more than a predetermined amount, the biasing member extends the snuffer to the raised position in response to an impact between the torch and a surface that supported the torch prior to the flame bowl departing from the upright position.

16. The torch of claim 15, further comprising a top plate fixed in a position over the flame bowl such that the snuffer comes into contact with the top plate when in the raised position.

17. The torch of claim 16, further comprising a detached weight that sits in contact with a snuffer shelf proceeding from the sleeve when the flame bowl is in the upright position and moves away from the shelf allowing the snuffer to extend when the flame bowl departs from the upright position in response to the impact of the torch with the surface that supported the torch prior to the flame bowl departing from the upright position.

18. The torch of claim 17, wherein the flame bowl is at least partially frustoconical with the wick holder and the snuffer sleeve extending below a lower center portion thereof such that when the flame bowl is upright with the snuffer sleeve in the lowered position, the detached weight will move into contact with a shelf on the snuffer sleeve to retain the snuffer sleeve in the lowered position.

19. The torch of claim 18, further comprising a grate over the flame bowl for preventing loss of the free weight.

* * * * *